US005932125A

United States Patent [19]

Kawata et al.

[11] Patent Number: 5,932,125

[45] Date of Patent: Aug. 3, 1999

[54] ROLLER FOR FIXING TONER AND METHOD FOR MANUFACTURING SAME

[75] Inventors: Noriaki Kawata; Yoji Yamada; Yasushi Iguchi, all of Nagano, Japan

[73] Assignee: Fuji Electric Co., Ltd., Japan

[21] Appl. No.: 08/739,844

[22] Filed: Oct. 30, 1996

[30] Foreign Application Priority Data

Nov. 16, 1995 [JP] Japan ..... 7-297990

[51] Int. Cl.[6] ..... G03G 15/20

[52] U.S. Cl. ..... 219/216; 399/333

[58] Field of Search ..... 219/216, 469, 219/538, 543, 552, 553; 399/331, 333; 492/46

[56] References Cited

U.S. PATENT DOCUMENTS

| | | | |
|---|---|---|---|
| 4,301,356 | 11/1981 | Tanei et al. | 219/552 |
| 4,745,431 | 5/1988 | Kogure et al. | 219/216 |
| 4,776,070 | 10/1988 | Shibata et al. | 492/46 |
| 4,801,968 | 1/1989 | Kogure et al. | 219/216 |
| 4,970,559 | 11/1990 | Miyabayashi et al. | 399/324 |
| 5,087,946 | 2/1992 | Dalal et al. | 219/216 |
| 5,191,381 | 3/1993 | Tuan | 219/216 |
| 5,204,723 | 4/1993 | Hanada et al. | 219/216 |
| 5,206,482 | 4/1993 | Smuckler | 219/553 |
| 5,250,228 | 10/1993 | Baigrie et al. | 219/216 |
| 5,286,952 | 2/1994 | McMills et al. | 219/553 |
| 5,355,204 | 10/1994 | Aoki | 219/216 |
| 5,382,384 | 1/1995 | Baigrie et al. | 219/553 |
| 5,403,993 | 4/1995 | Cordia et al. | 219/543 |
| 5,420,392 | 5/1995 | Sakata | 219/216 |
| 5,450,181 | 9/1995 | Tsukida et al. | 219/216 |
| 5,506,667 | 4/1996 | Kinoshita | 399/331 |
| 5,757,508 | 5/1998 | Murata | 219/216 |

FOREIGN PATENT DOCUMENTS 7-121044 5/1995 Japan .

*Primary Examiner*—Teresa Walberg
*Assistant Examiner*—J. Pelham
*Attorney, Agent, or Firm*—Morrison Law Firm

[57] ABSTRACT

A direct heating type toner fixing roller for electrophotographic apparatuses is composed of a cylindrical tube made of a resin into which are mixed electrically conductive additives, preferably carbon fiber and carbon black powder. The resin is injection molded under defined conditions so that a reverse crown profile is formed. The roller of the invention is held in place at the toner fixing position by shafts, and the shafts themselves are supported by flanges. Electric power is supplied to the cylindrical tube to heat the tube to a predetermined thermal toner-fixing temperature through power supply terminals in contact with electrically conductive flanges. Alternately, the power supply terminals may make direct contact with peripheral parts of the cylindrical tube to heat the tube.

9 Claims, 3 Drawing Sheets

ROLLER FOR FIXING TONER AND METHOD FOR MANUFACTURING SAME

BACKGROUND OF THE INVENTION

The present invention relates to a roller for fixing toner onto paper (hereinafter referred to as a "toner fixing roller" or simply as a "fixing roller") in electrophotographic apparatuses such as copying machines, printers and facsimile machines.

Referring now to FIGS. 4(*a*) and 4(*b*), in a conventional toner fixing roller of the indirect heating type, the fixing roller 1 includes an aluminum tube A, an ethylene tetrafluoride coating C on aluminum tube A, and an electric heater H inserted into aluminum tube A. Electric power from electric power supply E is supplied to heater H through lead wires L to heat aluminum tube A. The ethylene tetrafluoride coating C prevents toner T from sticking onto the surface of fixing roller 1, a phenomenon called "toner offset". As recording paper P on which toner T is lightly deposited as part of a copying/printing process passes between fixing roller 1 and a pressing roller R, fixing roller 1 is heated to a predetermined temperature to soften toner T and to fix toner T onto paper P.

Since electric heater H and aluminum tube A are spaced apart from each other in the indirect heating scheme, it takes some time to heat up aluminum tube A to a predetermined temperature after electric heater H is activated. This heating delay lowers the operating efficiency of the electrophotographic apparatus. Though the operating efficiency may be improved by making a heater current flow continuously, electric power consumption is detrimentally increased. The work of forming aluminum tube A, coating aluminum tube A, and inserting electric heater H all increase the manufacturing costs of the conventional indirect heating type fixing roller.

A direct heating type fixing roller has been developed recently (Japanese Unexamined Laid Open Patent Application No. H03-80279). This direct heating type fixing roller includes a metal core, an insulation layer on the metal core, a heating resistor layer on the insulation layer, and an ethylene tetrafluoride coating on the heating resistor layer. In the direct type fixing roller, heat from the heating resistor is directly transferred to the toner.

The main advantage to the direct heating type fixing roller is that it requires much less time to attain a predetermined temperature. However, it is necessary to form three layers on the metal core and secure sufficient adhesion between the layers. Furthermore, a direct heating type fixing roller requires countermeasures against thermal expansion of the roller during heating. Therefore, the number of manufacturing steps and the manufacturing costs are increased.

Additionally, the diameter of the fixing roller must be reduced gradually toward the center thereof (hereinafter referred to as a "reverse crown profile") to avoid paper furrowing during toner fixing. Steps taken to generate a reverse crown profile further increase the cost of the direct heating type fixing roller.

OBJECTS AND SUMMARY OF THE INVENTION

In view of the foregoing, it is an object of the invention to provide a toner fixing roller which quickly heats up to an appropriate temperature.

It is another object of the invention to provide a toner fixing roller which prevents toner offset.

It is still another object of the invention to provide a method to manufacture a toner fixing roller having a reverse crown profile.

It is still another object of the invention to minimize the number of manufacturing steps required to create a direct heating type fixing roller.

Briefly stated, the present invention is a direct heating type toner fixing roller for electrophotographic apparatuses. It is composed of a cylindrical tube made of a resin into which are mixed electrically conductive additives, preferably carbon fiber and carbon black powder. The resin is injection molded under defined conditions so that a reverse crown profile is formed. The roller of the invention is held in place at the toner fixing position by shafts, and the shafts themselves are supported by flanges. Electric power is supplied to the cylindrical tube to heat the tube to a predetermined thermal toner-fixing temperature through power supply terminals in contact with electrically conductive flanges. Alternately, the power supply terminals may make direct contact with peripheral parts of the cylindrical tube to heat the tube.

Another aspect of the present invention relates to a method of manufacturing the roller described above. The method involves injection-molding the cylindrical tube in a molding die having a side gate structure with an odd number of gates, and the odd number being between 3 and 9.

According to an embodiment of the present invention there is disclosed a toner fixing roller for an electrophotographic apparatus comprising a cylindrical tube made of resin, the cylindrical tube having an outer surface, an inner surface, and two ends, and electrically conductive additives mixed with the resin.

According to another embodiment of the present invention there is disclosed a method to manufacture a toner fixing roller, the roller including a cylindrical tube made of a resin, and electrically conductive additives mixed with the resin, comprising the steps of setting a molding die having a side gate structure to have an odd number of side gates, wherein the odd number is not less than 3, and injection-molding a cylindrical tube in the molding die.

The above, and other objects, features, and advantages of the present invention will become apparent from the following description read in conjunction with the accompanying drawings, in which like reference numerals designate the same elements.

BRIEF DESCRIPTION OF THE DRAWINGS

FIG. 3(*b*) is a radial cross section of the roller of FIG. 3(*a*).

FIG. 3(*c*) is a cross section along the rotation axis of a toner fixing roller showing a third power supply configuration of the present invention, wherein electric power is supplied to the inner surface of the roller.

FIG. 3(*d*) is a radial cross section of the roller of FIG. 3(*c*).

FIG. 4(*b*) is a cross section along the rotation axis of the prior art fixing roller of FIG. 4(*a*).

DETAILED DESCRIPTION OF THE PREFERRED EMBODIMENTS

Figure 1:
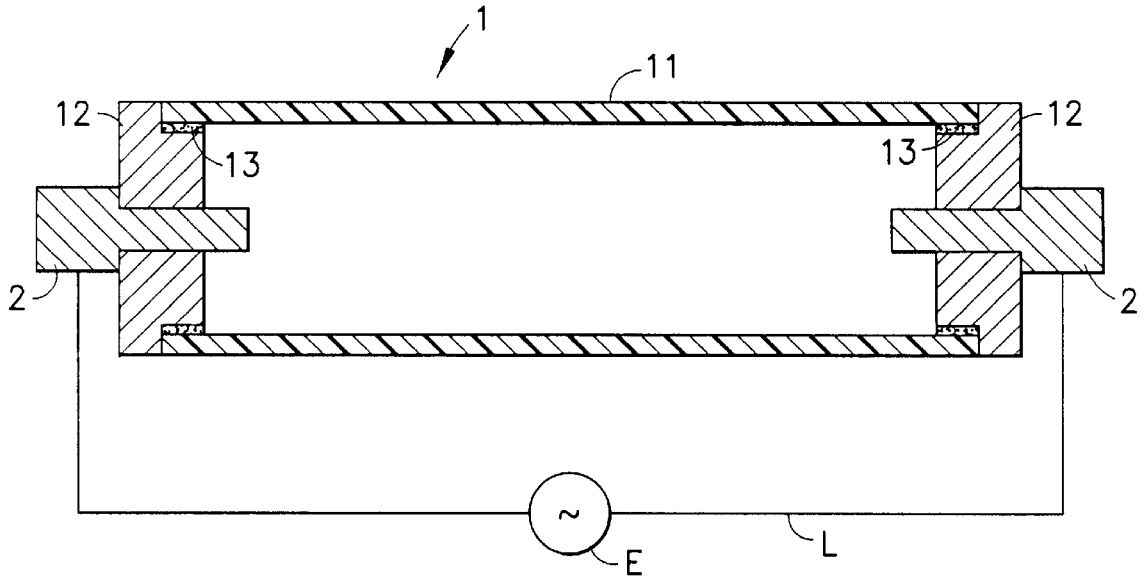
FIG. 1 is a cross section along the rotation axis of a toner fixing roller showing a first power supply configuration of the present invention, wherein electric power is supplied through electrically conducting flanges in electrical contact with the toner fixing roller.

The toner fixing roller of the present invention comprises a cylindrical resin tube. Electrically conductive additives are mixed with the resin of the cylindrical resin tube. The cylindrical resin tube is heated by supplying electric power to both ends of the cylindrical resin tube.

The resin of the toner fixing roller must possess sufficient mechanical strength, heat resistance and limited toner adhesion. In order to attain the dimensional precision required, the resin must also be well suited for injection molding. Polyphenylenesulfide resin (herein after referred to as "PPS resin"), polyphthalamide resin, and liquid crystal polymer resins meet the foregoing requirements.

Carbon black powder and carbon fiber preferably are used as the electrically conductive material. Carbon black powder and carbon fiber exhibit high electrical conductivity and high heat resistance. In addition, the carbon fiber and carbon black powder act to reinforce the resin physically. The mixing ratio of the carbon fiber and carbon black powder to the resin is preferably within the range from about 10 to 50 weight percent, and the weight ratio of the carbon black powder to the carbon fiber is preferably more than 0.25 and less than 4.5. In mixing carbon black powder in the resin, calcium carbonate or sintered clay is added to uniformly disperse the carbon black powder.

By mixing the carbon fiber with the resin, the electrical conductivity of the resin is improved in the extending direction of the carbon fiber, and the mechanical strength of the resin is also increased. However, the electrical conductivity of the resin is extremely low in the directions perpendicular to the extending direction of the carbon fiber. Since the fibers tend to orient in the longitudinal direction (along the axis of rotation of the roller during injection molding, the electrical conductivity of the roller is improved in the radial direction thereof by filling with carbon black powder between the fibers.

The waiting time limit is considered to be 20 sec or less for heating the roller to the toner fixing temperature of from 130° C. to 180° C. It has been found that the preferable resistance value between both ends of the fixing roller of the present invention is 20 Ω or less. When the cylindrical resin tube is 30 mm in diameter and from 260 to 320 mm in length, a tube thickness of from 1.0 to 1.5 mm is sufficient to provide the roller with the necessary mechanical strength. The volume resistivity of the resin material prepared in this manner is then calculated from the resistance measured between both ends of the cylindrical resin tube, and the average diameter and thickness of the tube. On the basis of these values of the above parameters, the upper limit of the volume resistivity is calculated to be about 1 Ω cm, measured in a longitudinal direction along the rotational axis.

The above described volume resistivity is obtained by mixing the carbon black powder and carbon fiber in the resin at a weight ratio between 10 to 50 percent for the cylindrical tube, and by confining the weight ratio of the carbon black powder to the carbon fiber within the range between 0.25 and 4.5.

To heat the tube, electrically conductive connecting terminals may make contact with electrically conductive flanges inserted in the ends of the cylindrical tube, or electrically conductive connecting terminals may directly contact the cylindrical tube. In either case, it is necessary for the power supply terminals to slide, since the cylindrical resin tube is rotating. When the power supply terminals directly contact the cylindrical tube, the flanges may be made of an insulating material. The electrically conductive connecting terminals are pressed to the flanges or the cylindrical tube under appropriate force by coil springs or plate springs, respectively.

Another aspect of the present invention relates to a method of manufacturing the roller described above. The method involves injection-molding the cylindrical tube in a molding die having a side gate structure with an odd number of gates, and the odd number being not less than 3. Preferably, the odd number is between 3 and 9.

Preferably, the outer diameter of the central part of the cylindrical tube is shorter by about 0.01 to 0.10 mm than the outer diameter of both ends of the cylindrical tube. This profile of the fixing roller according to the invention prevents the paper from being furrowed during toner fixing. A fixing roller having such a reverse crown profile is molded by setting the injection pressure at around 196 MPa and by setting the number of injection gates at an odd number between 3 and 9.

FIG. 1 is a cross section along the rotation axis of a toner fixing roller 1 showing a first power supply scheme of the present invention. Referring now to FIG. 1, metal flanges 12 are bonded to a cylindrical resin tube 11 with electrically conductive adhesives 13. Electrically conductive adhesives 13 electrically connect flanges 12 uniformly to cylindrical resin tube 11. Metal shafts 2, connected to a power supply E via lead wires L, contact respective flanges 12. Electric power supply E is any convenient source such as, for example, 100 V AC. Electric power is supplied through metal shaft 2 to cylindrical resin tube 11 to heat cylindrical resin tube 11.

Figure 2:
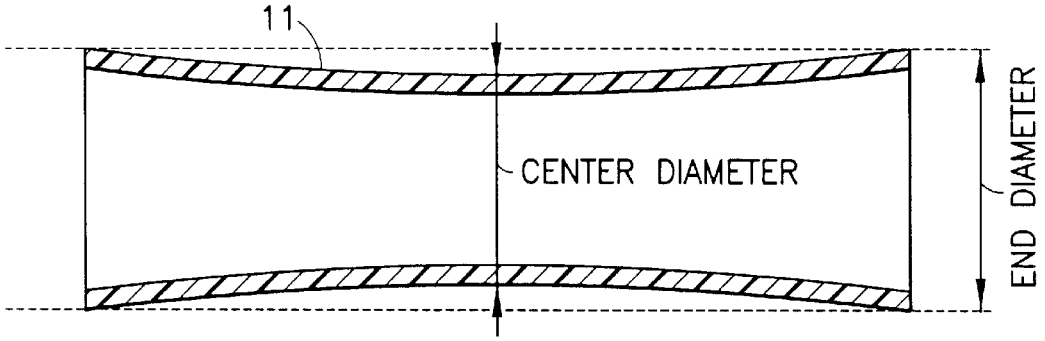
FIG. 2 is a cross section along the rotation axis of a cylindrical resin tube having a reverse crown profile according to the present invention.
Figure 3A:
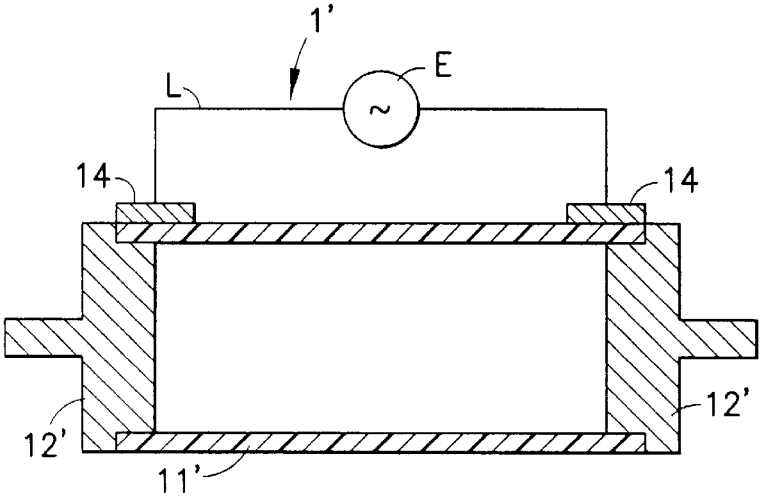
FIG. 3(*a*) is a cross section along the rotation axis of a toner fixing roller showing a second power supply configuration of the present invention, wherein electric power is supplied to the outer surface of the roller.
Figure 3B:
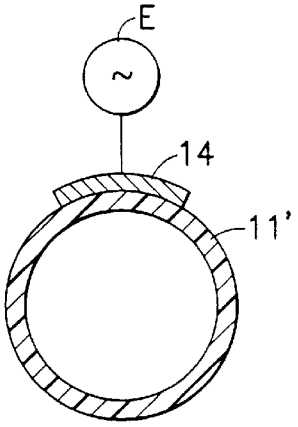
Figure 3C:
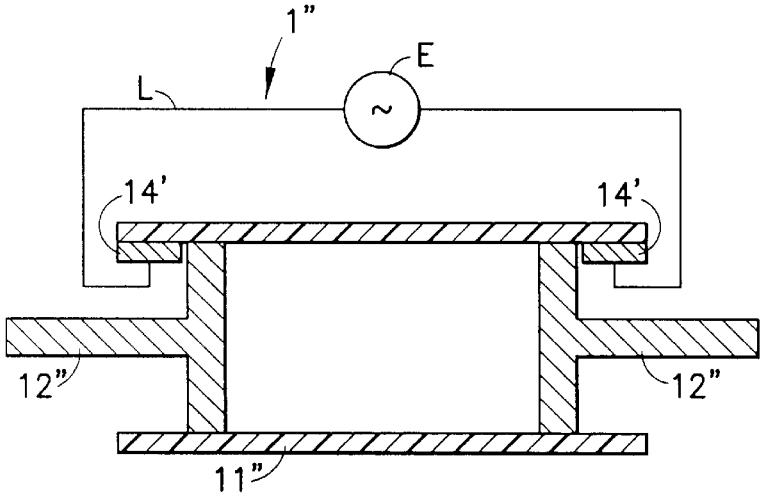
Figure 3D:
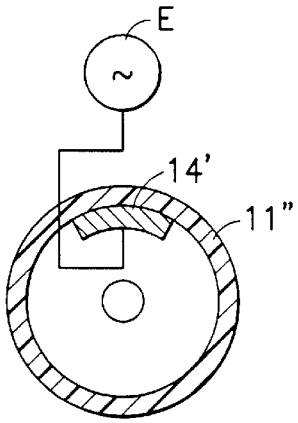
Figure 4A:
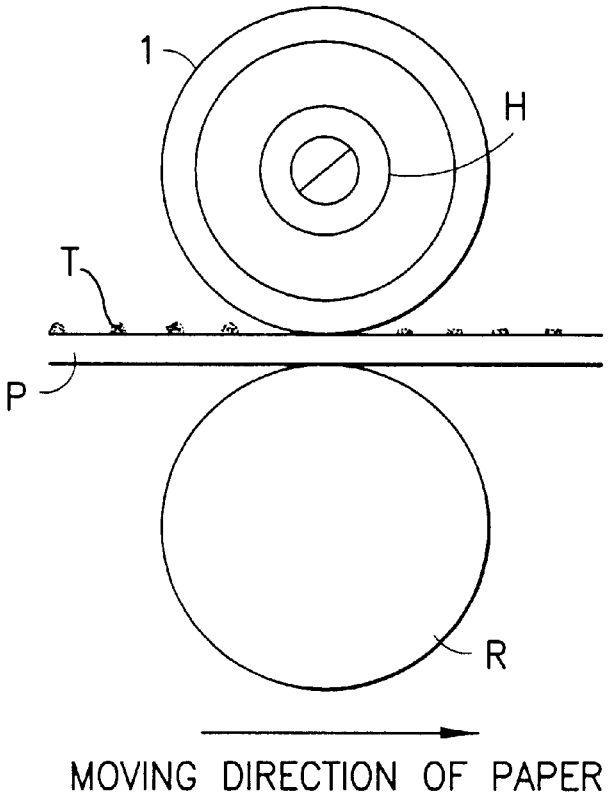
FIG.4a PRIOR ART
FIG. 4(*a*) is a radial cross section perpendicular to the rotation axis of a prior art fixing roller of the indirect heating type.
Figure 4B:
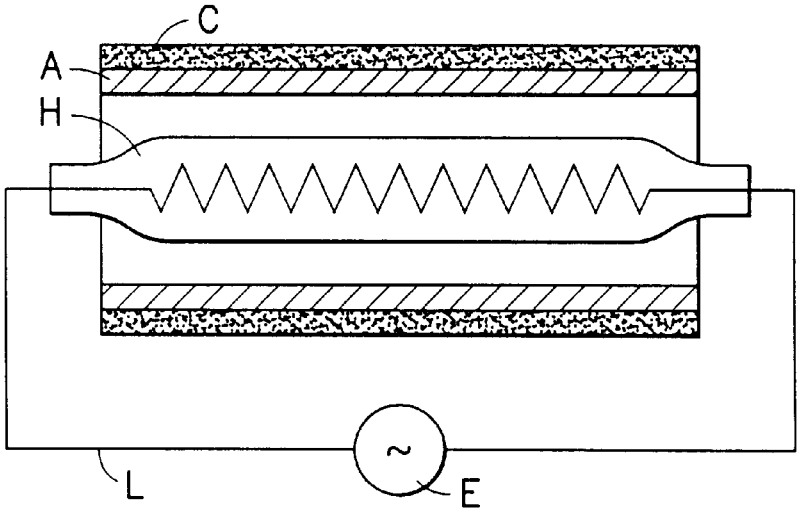
FIG.4b PRIOR ART

FIG. 2 is a cross section along the rotation axis of cylindrical resin tube 11 having a reverse crown profile according to the invention. The central diameter of cylindrical resin tube 11 is less than the end diameters of cylindrical resin tube 11. This difference between the center diameter and the end diameters is preferably between about 0.01 and 0.10 mm.

FIG. 3(*a*) is a cross section along a rotation axis of a toner fixing roller 1', showing a second power supply scheme of the present invention. This scheme supplies electric power to the outer surface of toner fixing roller 1'. FIG. 3(*b*) is a radial cross section of the roller of FIG. 3(*a*). FIG. 3(*c*) is a cross section along a rotation axis of toner fixing roller 1', showing a third power supply scheme of the invention, which supplies electric power to the inner surface of toner fixing roller 1". FIG. 3(*d*) is a radial cross section of the roller of FIG. 3(*c*).

Referring now to FIGS. 3(*a*) through 3(*d*), power supply terminals 14, 14' are made of a highly conductive and relatively soft metal or alloy, such as copper or a copper alloy. Power supply terminals 14, 14' have a contact face having the same curvature as that of the outer or inner surface of cylindrical resin tubes 11', 11". Cylindrical resin tubes 11', 11" are mounted on flanges 12', 12". Electric power is supplied to the terminal ends of cylindrical resin tubes 11', 11" through power supply terminals 14, 14' via lead wire L connected to electric power supply E. Power supply terminals 14, 14' are arranged near the ends of cylindrical resin tubes 11', 11" such that the contact faces thereof are aligned in coplanarity with the outer or inner surface of cylindrical resin tubes 11', 11". Terminals 14, 14' are pressed to the surface of cylindrical resin tubes 11', 11" by springs (not shown) to lower the contact resistance.

Five cylindrical PPS resin tubes A through E, each 30 mm in outer diameter, 28 mm in inner diameter and 260 mm in length, were fabricated by injection molding. Carbon black was added to the resin as the electrically conductive powder. Electrically conductive carbon fiber was also added to the PPS resin, to reinforce the PPS resin. The mixing ratios of the resin and the electrically conductive materials were changed from tube to tube.

A molding die used for injection molding had a gate side core diameter of 28 mm and a vent side core diameter of 27 mm. The molding die had a gradient of 1/240 to facilitate pulling out the molded tubes. The molding die was provided with five gates. When two gates were provided, the resin flow during injection molding had a circumferential component, which increased the rate of the carbon fiber orienting in the circumferential direction. The increased orientation of the carbon fiber in the circumferential direction lowered the resistance of the cylindrical resin tube. Conditions for the injection molding included a resin temperature of 350 °C., die temperature of 150 °C., and injection pressure of 245 MPa.

Table 1 lists the mixing ratios of the PPS resin, carbon black, carbon fiber and the other inorganic ingredients for the cylindrical resin tubes A through E. The volume resistivity values of the resin tubes A through E are also listed in Table 1.

TABLE 1

| | A | B | C | D | E |
|---|---|---|---|---|---|
| PPS resin | 60 | 55 | 50 | 50 | 55 |
| Carbon black | 5 | 10 | 10 | 20 | 18 |
| Carbon fiber | 20 | 30 | 5 | 5 | 4 |
| Inorganic ingredients | 15 | 5 | 35 | 25 | 23 |
| Mixing ratios (Carbon black/carbon fiber) | 0.25 | 0.33 | 2 | 4 | 4.5 |
| Volume resistivity (Ω cm) | 4.5 | 0.45 | 0.65 | 0.87 | 8.7 |

Metal shafts 2, connected to a power supply (100 V AC) via lead wires L, were inserted into respective flanges 12. Electric power E was supplied to cylindrical resin tube 11 to heat cylindrical resin tube 11 of rollers A through E. Table 2 lists the results of the heating test of rollers A through E. Resistance values across the length of the respective rollers, temperature rise periods, and toner offset are also listed in Table 2.

TABLE 2

| Sample Roller | A | B | C | D | E |
|---|---|---|---|---|---|
| Resistance across roller length (Ω) | 100 | 10 | 15 | 20 | 2000 |
| Temperature rise time (sec) | 90 | 10 | 15 | 20 | * |
| Toner offset | Good | Good | Good | Good | — |

*Saturation at 50° C.

As Table 2 indicates, fixing roller temperature rises from room temperature to 160° C. in less than 20 sec in sample rollers B, C, and D, in which the weight ratios of the carbon black to the carbon fiber is within the range between 0.33 and 4. It took 90 sec to heat sample roller A from room temperature to 160° C. Sample roller E failed to heat up to more than 50° C., though sample roller E was heated for an extended period of time. Sample rollers A, B, C and D exhibited minimal toner offset. Though not described in Table 2, it has been found that the toner offset characteristics are not affected by coating the roller surface with fluororesin paint.

Sample rollers F, G, and H were fabricated by attaching a surface layer on each of sample rollers B, C, and D, respectively. The surface layer was made from Emralon 352 (supplied by Japan Acheson Co., Ltd.), a material composed of 30 weight percent cold-cure type fluorocarbon resin and 70 weight percent thermosetting resin. In these examples, the cold-cure type resin was specifically polytetrafluoroethylene, and the thermosetting resin was specifically alkyd resin. The dried thickness of the surface layer was 10 μm.

Sample rollers I, J, and K were fabricated by attaching a surface layer on each of the sample rollers B, C, and D, respectively. The surface layer was made from Emralon 330 (supplied by Japan Acheson Co., Ltd.), a material composed of 20 weight percent cold-cure type fluorocarbon resin and 80 weight percent thermosetting resin. In these examples, the cold-cure type resin was specifically polytetrafluoroethylene, and the thermosetting resin was specifically phenolic resin. The dried thickness of the surface layer was 20 μm.

Heating tests were performed on sample rollers F–K in the same manner as for sample rollers A–E. The results are shown in Tables 3 and 4.

TABLE 3

| Sample Roller | F | G | H |
|---|---|---|---|
| Resistance across roller length (Ω) | 10 | 15 | 20 |
| Temperature rise time (sec) | 10 | 15 | 20 |
| Toner offset | Good | Good | Good |

TABLE 4

| Sample Roller | I | J | K |
|---|---|---|---|
| Resistance across roller length (Ω) | 10 | 15 | 20 |
| Temperature rise time (sec) | 10 | 15 | 20 |
| Toner offset | Good | Good | Good |

Tables 3 and 4 indicate that the temperature rise times for sample rollers F and I were the same as that for sample roller B; the temperature rise times for sample rollers G and J were the same as that for sample roller C; and the temperature rise times for sample rollers H and K were the same as that for sample roller D. However, the sample rollers coated with cold curing fluorocarbon resin exhibited better toner offset performance than did sample rollers B, C, and D. Generally, the thickness of the cold curing fluorocarbon resin layer is preferably between 5 and 50 μm, and best results were obtained with a thickness between 10 and 20 μm.

The relationship between four injection conditions, C1 through C4, and the resulting reverse crown profiles were investigated by fixing the mixing ratios at those of sample roller C, the resin temperature at 350° C. and the molding die temperature at 150° C. Table 3 shows the effect of the number of molding die gates and injection pressure values on the generation of reverse crown profiles.

TABLE 5

| | C1 | C2 | C3 | C4 |
|---|---|---|---|---|
| Number of gates | 3 | 7 | 3 | 7 |
| Injection pressure (MPA) | 245 | 245 | 196 | 196 |
| Gate side diameter (mm) | 30.010 | 30.015 | 30.000 | 30.005 |
| Center diameter (mm) | 30.000 | 30.000 | 29.950 | 29.905 |
| Vent side diameter (mm) | 30.009 | 30.010 | 29.998 | 30.002 |

As Table 5 indicates, the center diameter of the molded tubes formed under an injection pressure of 196 MPa is shorter by from 0.01 to 0.10 mm than the diameter of the ends, whether three or seven gates are employed. Under an injection pressure of 245 MPa, the reverse crown profile is less pronounced. Thus, there exist certain optimal ranges for the gate number and injection pressure used in fabrication of these molded tubes.

A toner fixing roller was assembled by inserting flanges 12*a* into the cylindrical resin tube 11 of the sample roller C4, described in Table 5. This toner fixing roller was mounted on a printer to examine its toner fixing performance. By feeding a heater current of 10 A according to the second or third power supply scheme, the fixing roller was heated up to 130° C. in from 10 to 13 sec, and the toner was fixed excellently, without any toner offset.

The present invention reduces considerably the time required for the toner fixing roller to heat up to an appropriate temperature. Furthermore, the faster warmup requires less electric power for pre-heating.

Additionally, by adopting polyphenylenesulfide resin, polyphthalamide resin and liquid crystal polymer resins as the resin of the roller, the toner fixing roller of the present invention does not cause any toner offset and is not degraded, even when the roller is kept at the toner fixing temperature for many hours.

Furthermore, by providing the toner fixing roller of the present invention with a reverse crown profile, the center diameter thereof being shorter by from 0.01 to 0.10 mm than the diameter of the ends thereof, recording paper is not furrowed during toner fixing. A reverse crown profile is generated by providing the injection molding die with an odd number of gates. It was found that for the dimensions of the test rollers, the odd number should be between 3 and 9.

Additionally, electric power can be easily and stably supplied to the rotating toner fixing roller for heating in several ways, either 1) by contacting power supply terminals with electrically conductive flanges inserted into the cylindrical resin tube and bonded using an electrically conductive adhesive, or 2) by contacting power supply terminals with the peripheral parts of the cylindrical resin tube.

Having described preferred embodiments of the invention with reference to the accompanying drawings, it is to be understood that the invention is not limited to those precise embodiments, and that various changes and modifications may be effected therein by one skilled in the art without departing from the scope of the invention as defined in the appended claims.

What is claimed is:

1. A roller for fixing toner on paper in an electrophotographic apparatus, said roller comprising:

a cylindrical tube made of a resin, carbon black powder, carbon fiber, and a quantity of one of calcium carbonate and sintered clay effective to uniformly disperse said carbon black powder in said resin;

said cylindrical tube having an outer surface, an inner surface, and two ends;

said carbon black powder and carbon fiber being present at a total mixing ratio with respect to said resin from about 10 to 50 weight percent, and said carbon black powder and carbon fiber being present at a weight ratio of said carbon black powder to said carbon fiber between more than 0.25 and less than 4.5;

said resin containing substantially one member selected from the group consisting of polyphenylenesulfide resin, polyphthalamide resin, and liquid crystal polymer resin; and said roller having a total resistance value, between said two ends, of not more than 20Ω.

2. The roller according to claim 1, wherein a first diameter of said outer surface at a central part of said cylindrical tube is shorter by from 0.01 to 0.10 mm than a second diameter of said outer surface at each of said two ends of said cylindrical tube.

3. The roller according to claim 1, further comprising:

shafts and flanges supporting said shafts;

said shafts and flanges being inserted into respective open ends of said cylindrical tube, to hold said cylindrical tube at a toner fixing position.

4. The roller according to claim 3, wherein said flanges are made of an electrically conductive material and electrically connected to said respective open ends of said cylindrical tube.

5. The roller according to claim 4, further comprising:

power supply terminals;

said power supply terminals making contact with said electrically conductive flanges to supply electric power to said cylindrical tube to heat said cylindrical tube to a thermal toner-fixing temperature.

6. The roller according to claim 3, further comprising:

power supply terminals;

said power supply terminals making contact with peripheral parts of said cylindrical tube, to supply electric power to said cylindrical tube to heat said cylindrical tube to a thermal toner-fixing temperature.

7. The roller according to claim 6, wherein each of said power supply terminals includes a contact face having a conforming surface to said outer surface of said cylindrical tube.

8. The roller according to claim 6, wherein each of said power supply terminals includes a contact face having a conforming surface to said inner surface of said cylindrical tube.

9. A roller according to claim 1, further comprising said roller having a volume resistivity of not more than 1 Ω cm in a longitudinal direction and a wall thickness of between about 1.0 and 1.5 mm.

* * * * *